US012503330B2

(12) United States Patent
De Marco et al.

(10) Patent No.: US 12,503,330 B2
(45) Date of Patent: Dec. 23, 2025

(54) SHEET STACKING EQUIPMENT

(71) Applicant: TECNAU S.r.l., Ivrea (IT)

(72) Inventors: Emanuela De Marco, Ivrea (IT); Rudi Bressan, Ivrea (IT); Davide Gianetta, Ivrea (IT)

(73) Assignee: Tecnau S.r.l., Ivrea (IT)

( * ) Notice: Subject to any disclaimer, the term of this patent is extended or adjusted under 35 U.S.C. 154(b) by 802 days.

(21) Appl. No.: 17/844,840

(22) Filed: Jun. 21, 2022

(65) Prior Publication Data

US 2022/0402720 A1 Dec. 22, 2022

(51) Int. Cl.

| | |
|---|---|
| ***B65H 31/04*** | (2006.01) |
| ***B65H 29/24*** | (2006.01) |
| ***B65H 31/34*** | (2006.01) |

(52) U.S. Cl.

CPC ..... *B65H 29/242* (2013.01); *B65H 31/04* (2013.01); *B65H 31/34* (2013.01); *B65H 2511/15* (2013.01); *B65H 2553/44* (2013.01)

(58) Field of Classification Search

CPC ..... B65H 29/242; B65H 31/04; B65H 31/34; B65H 2511/15; B65H 2553/44

See application file for complete search history.

(56) References Cited

U.S. PATENT DOCUMENTS

| | | | | |
|---|---|---|---|---|
| 4,470,591 A | 9/1984 | Acquaviva | | |
| 5,076,754 A | 12/1991 | Ebmeyer | | |
| 5,671,920 A * | 9/1997 | Acquaviva | B65H 29/32 | 271/197 |
| 8,066,282 B2 | 11/2011 | Mueller | | |
| 8,141,869 B2 | 3/2012 | Benjaminsson | | |
| 2008/0230978 A1* | 9/2008 | Moore | B65H 29/32 | 271/278 |
| 2021/0039905 A1* | 2/2021 | Kaufmann | B02C 18/2216 | |

FOREIGN PATENT DOCUMENTS

| | | | |
|---|---|---|---|
| EP | 2623005 A1 | | 8/2013 |
| EP | 3091250 | * | 11/2016 |
| JP | 2008266020 A | | 11/2008 |
| KR | 10-1633594 | * | 6/2016 |

* cited by examiner

*Primary Examiner* — Thomas A Morrison
(74) *Attorney, Agent, or Firm* — Loginov & Associates, PLLC; William A. Loginov

(57) ABSTRACT

Equipment for stacking sheets with a stack support, input rollers for feeding entering sheets and transport belts with lower branches arranged above the stack support. A compensation mechanism modifies the height of the stack support, while the transport belts are motorized to drag the entering sheets with the lower branches and deposit the sheets on the stack support or on stacked sheets. An arrest member is provided for the entering sheets, a pressure member for the stack to be stacked and a sensor device for a last sheet of the stack. The arrest member arrests the sheets in stacking while the pressure member is contiguous to the stop member and operates on the last sheet of the stack with a stabilizing function and in which the compensation mechanism is servoized to the sensor, for maintaining constant the height of the last sheet of the stack from a reference plane.

15 Claims, 10 Drawing Sheets

SHEET STACKING EQUIPMENT

RELATED APPLICATION

This application claims priority to Italian Application No. 102021000016211 filed on Jun. 21, 2021 and entitled EQUIPMENT FOR STACKING SHEETS, the teachings of which is expressly incorporated herein by reference.

FIELD OF THE INVENTION

The present invention relates to an equipment for stacking paper sheets, and more particularly transport belts with lower branches disposed above the stack support, a compensation mechanism for modifying the height of the stack and wherein the transport belts are motorized for shifting entering sheets with the lower branches and depositing the sheets on the stack support or on stacked sheets.

BACKGROUND OF THE INVENTION

Equipment of the type, for example represented in the U.S. Pat. No. 8,141,869 of Lasermax Roll System, are used for post-treatments of printed sheets.

Typically, the transport belts cause the entering sheets to slide onto the last sheet of the forming stack until the arrest. For sheets of large size and of a particular nature, such as coated paper sheets to be superimposed on each other, problems arise due to the difference in smoothness existing between printed sheets and unprinted sheets. This can cause the formation of bulges, in particular in the arrest area, which prevent an orderly stacking and with risk of jamming, especially in the case of stacking equipment at high operating speed, for example of the order of 250 m/min. Similar problems arise in the case of the use of uncoated sheets having different characteristics from sheet to sheet and/or to be stacked together with sheets of coated paper.

SUMMARY OF THE INVENTION

It is an object of the invention to provide a stacking equipment which can be used reliably, at high speed, with sheets of large dimensions and different characteristics of rigidity and smoothness.

According to this object, the sheet stacking equipment comprises an arrest member for the entering sheets, a pressure member for the stack being formed and a sensing device for the height of the stack being formed. The arrest member is designated for arresting the entering sheets; the pressing member is adjacent to the arrest member and operates on the last sheet of the stack in an area adjacent to the leading edge with stabilizing function, wherein the pressing member comprises a pressing cross member having a lower surface of contrast for the stack, and wherein the cross member operates on the pressing area of the last sheet of the stack with its lower surface.

According to another characteristic, the sheet stacking equipment comprises one or more ducts connected to a vacuum source, arranged transversally above the lower branches of the transport belts and with guide areas for the belt branches and a arrest member arranged downstream of the duct or ducts for arresting the entering and stacking sheets. The duct or ducts have openings in correspondence with the guide areas and the transport belts have longitudinal holes for ensuring a suction action on the entering sheets through said holes with traction by adherence of the sheets by the transport belts. In particular, the transport belts comprise a group of belts having a low coefficient of friction and a group of belts having a medium coefficient of friction.

BRIEF DESCRIPTION OF THE DRAWINGS

The characteristics of the invention will become clear from the following description, given purely by way of non-limiting example, with reference to the appended drawings in which.

DETAILED DESCRIPTION

Figure 1:
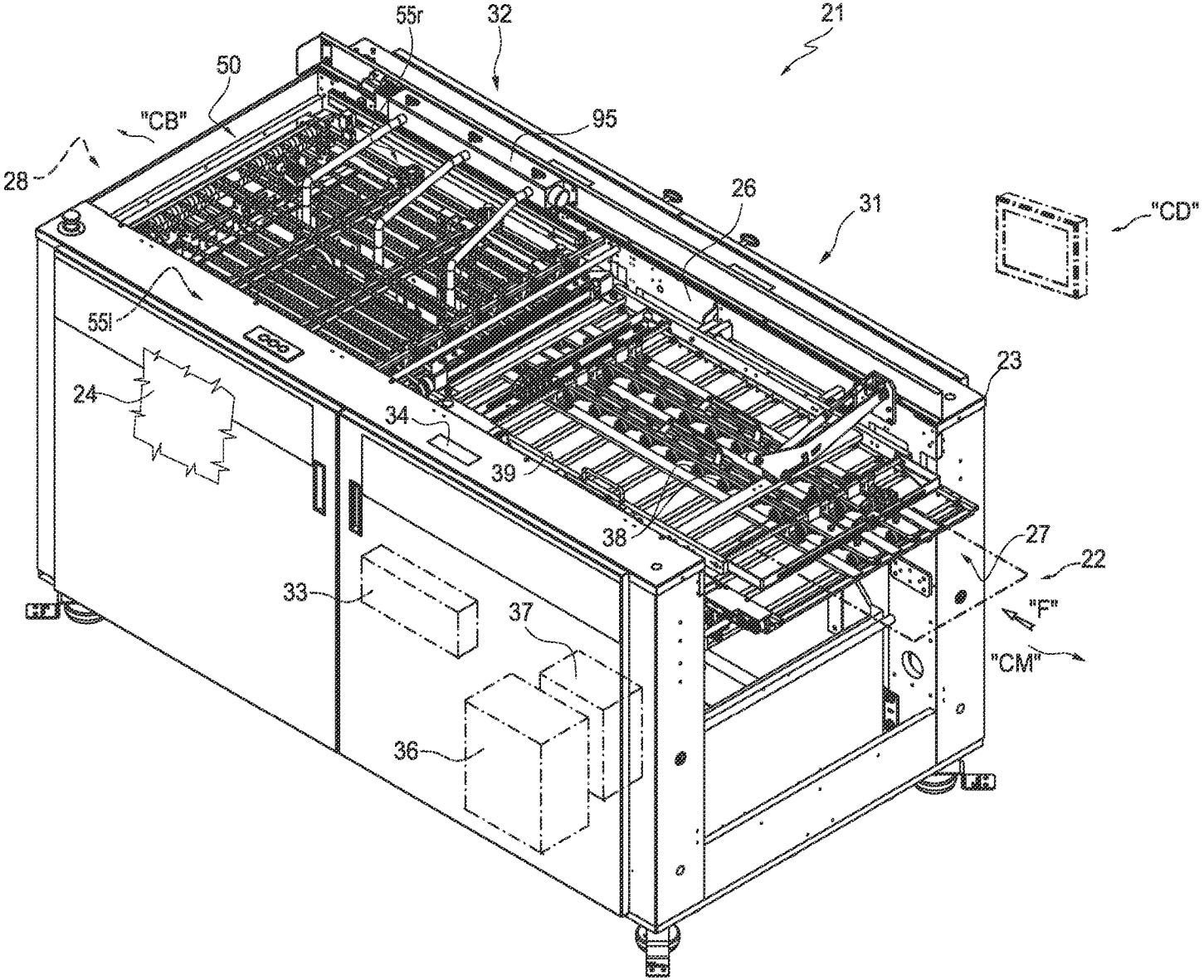
FIG. 1 represents a schematic perspective view, conventionally from the front, of a sheet stacking equipment according to the invention.
Figure 2:
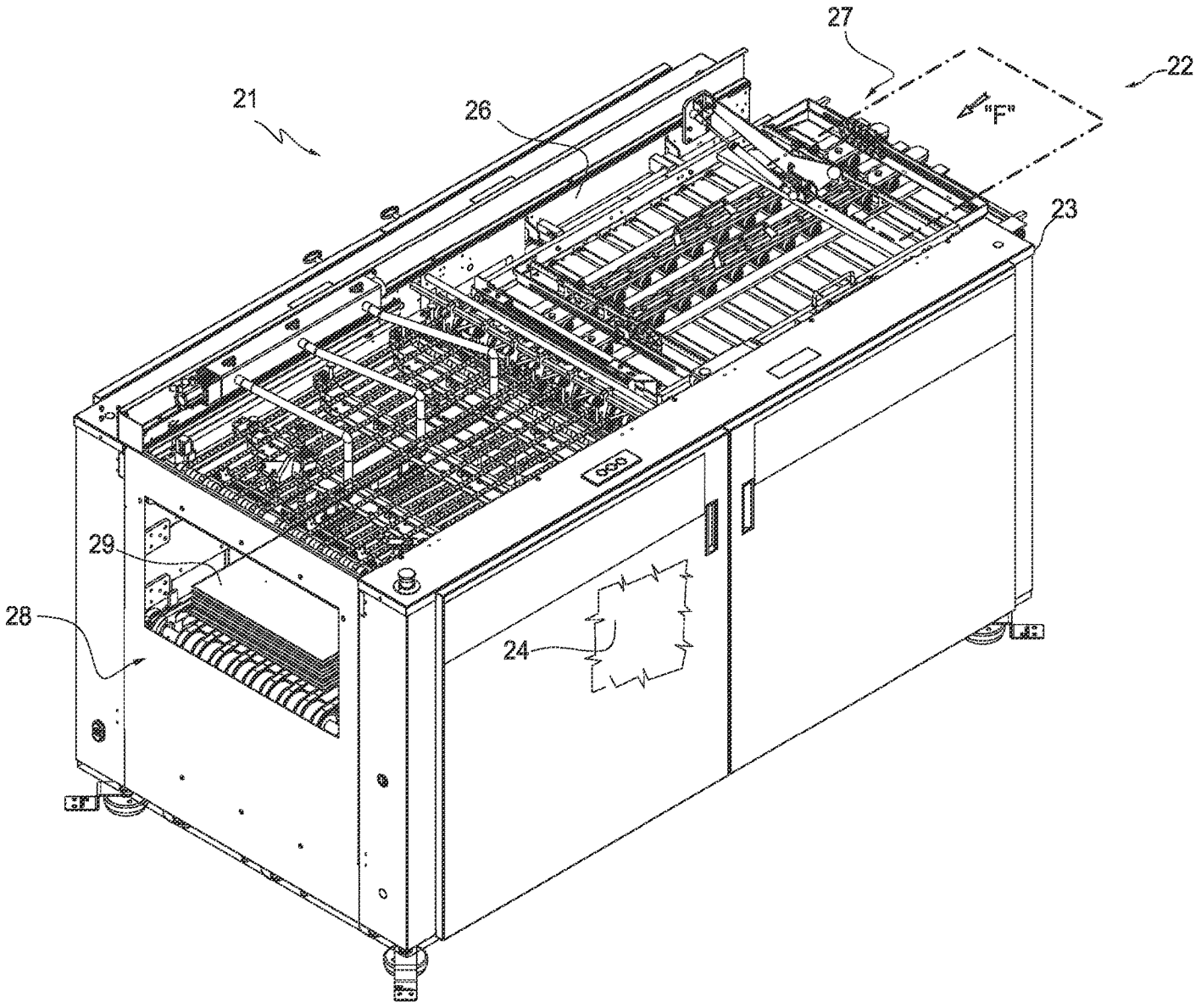
FIG. 2 shows a schematic perspective view, conventionally from the rear, of the equipment of FIG. 1.
Figure 3:
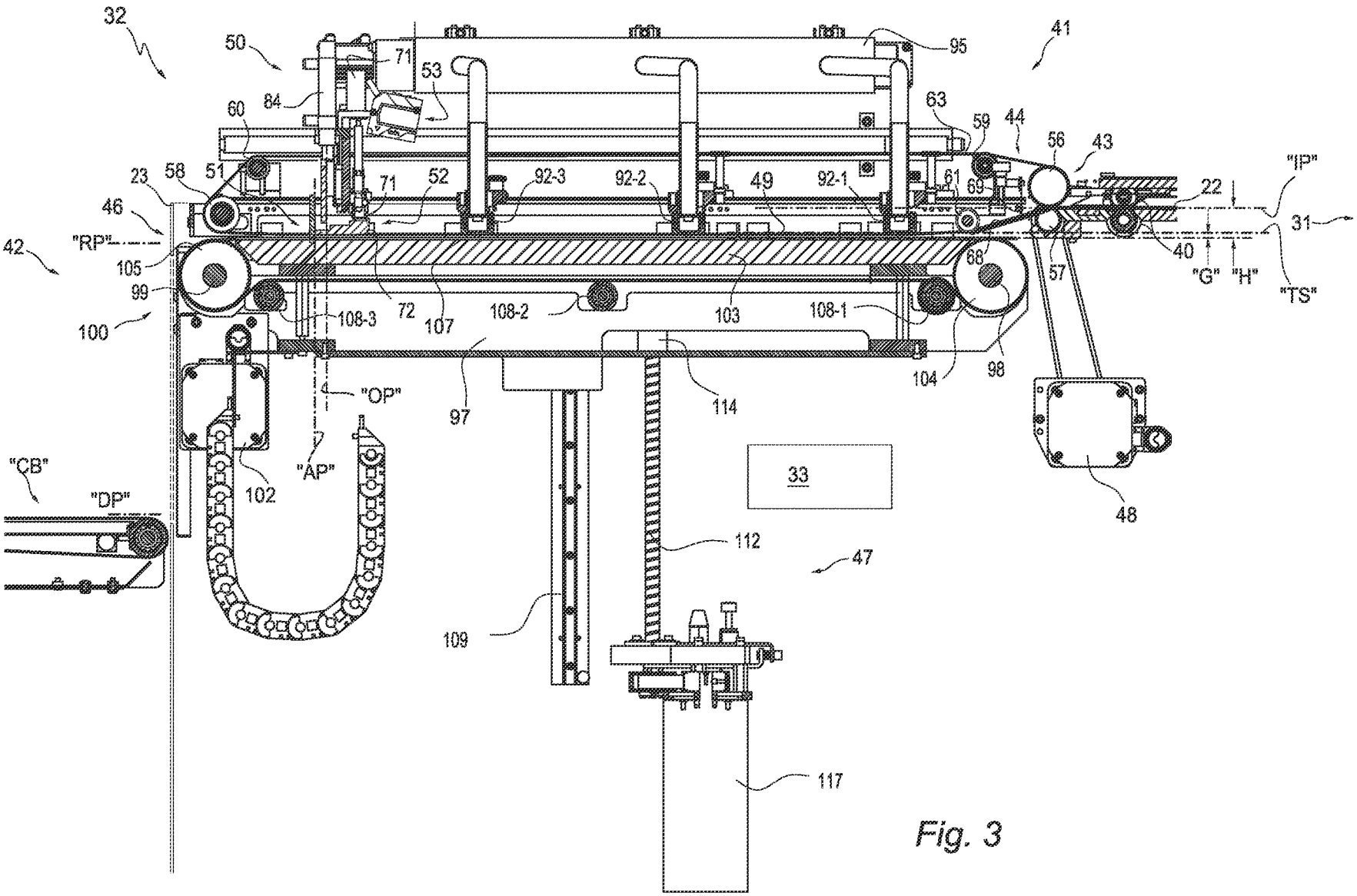
FIG. 3 represents a partial side section of the equipment of FIG. 1.

With reference to FIGS. 1, 2 and 3, the reference numeral 21 designates an equipment for stacking paper sheets 22 which includes a bodywork 23 and a frame with two sides 24 and 26, a front with an input gate 27 of the bodywork 23 and a respective rear with an output gate 28.

The stacking equipment 21, through the gate 27, receives the sheets 22 horizontally from an external feeding apparatus along a feed direction "F" and, after stacking, sends a stack 29 of superimposed sheets, through the gate 28, to an external user apparatus for subsequent treatments.

According to a typical application, the paper sheets 22 are fed by a cutter "CM", while the stack 29 is delivered to a conveyor belt "CB" for delivery to the user apparatus.

The sheet stacking equipment 21 comprises an alignment section 31, a stacking and delivering section 32, respectively on the front and on the back, an electronic control unit 33, a push-button panel 34 and sensor elements, not shown, arranged along the internal path of the sheets. The sensor elements are functionally connected to the electronic unit 33 for counting the sheets to be stacked and for detecting some operating conditions and anomalies. The equipment 21 further lodges, in a lower part, a vacuum pump 36 and, optionally, a compressed air generator 37 in case an external compressed air source is not available.

The equipment 21 is controlled by the feeding apparatus "CM", and the operating controls are carried out, for example, by means of a touch screen "CD" of the cutter "CM".

The alignment section 31 is disposed in an upper part of the bodywork 23 and has a front projecting part defining the input gate 27 and with a horizontal receiving surface for the sheets 22. A series of alignment rollers 38, mounted on a frame 39, operate above the receiving surface to align, according to predetermined rules, the edges of the sheets 22, and of side by side sheets. The aligned sheets 22 are then delivered, coplanar with the receiving surface, by a pair of delivery rollers 40 along the fed direction "F" toward the stacking and delivering section 32, with adequate spacing between sheet and sheet.

The frame 39 is hinged on the side 26 of the equipment and has the possibility of opening for an easy access to the receiving surface. The alignment section 31 is functionally of a known type and, for simplicity, the operational description thereof is omitted here.

The stacking and delivering section 32 is constituted by a transport and storage group 41 adjacent to the alignment section 31 and an accumulation and delivery group 42 disposed below the group 41. The transport and storage group 41 comprises input rollers 43 downstream of the delivery rollers 40 and transport belts 44 for receiving and positioning the entering sheets above the stack 29. The accumulation and delivery group 42 includes a stack support 46 for receiving the sheets in stacking and a compensation mechanism 47 for vertically moving the stack support 46.

Figure 3A:
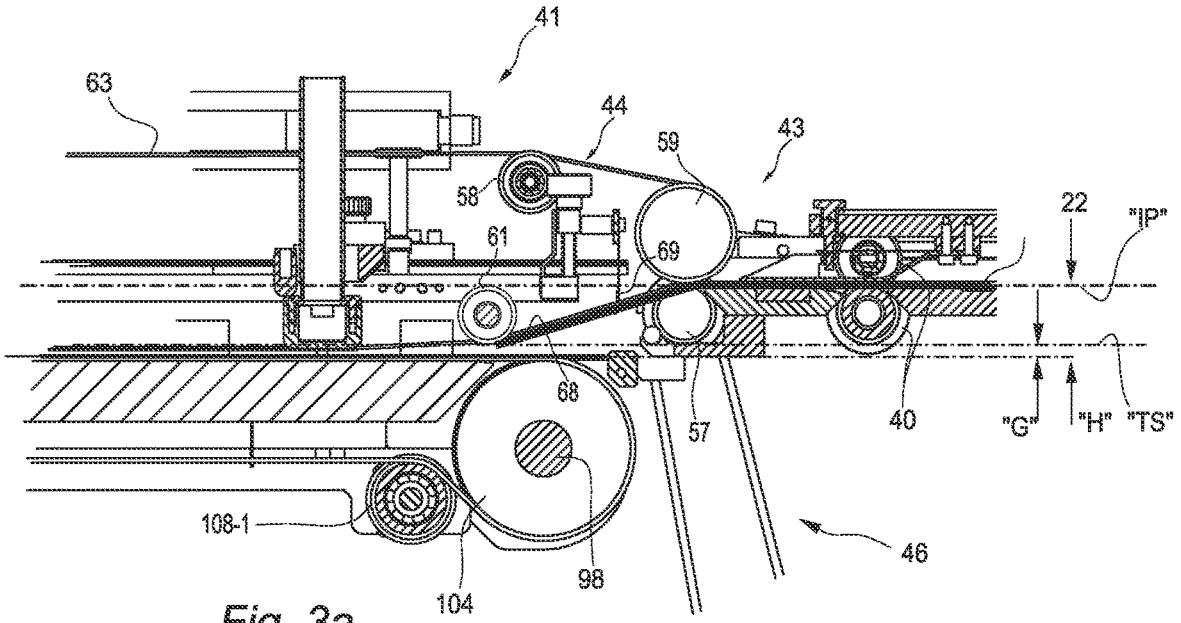
FIGS. 3*a* and 3*b* show some parts of FIG. 3, on an enlarged scale.
Figure 3B:
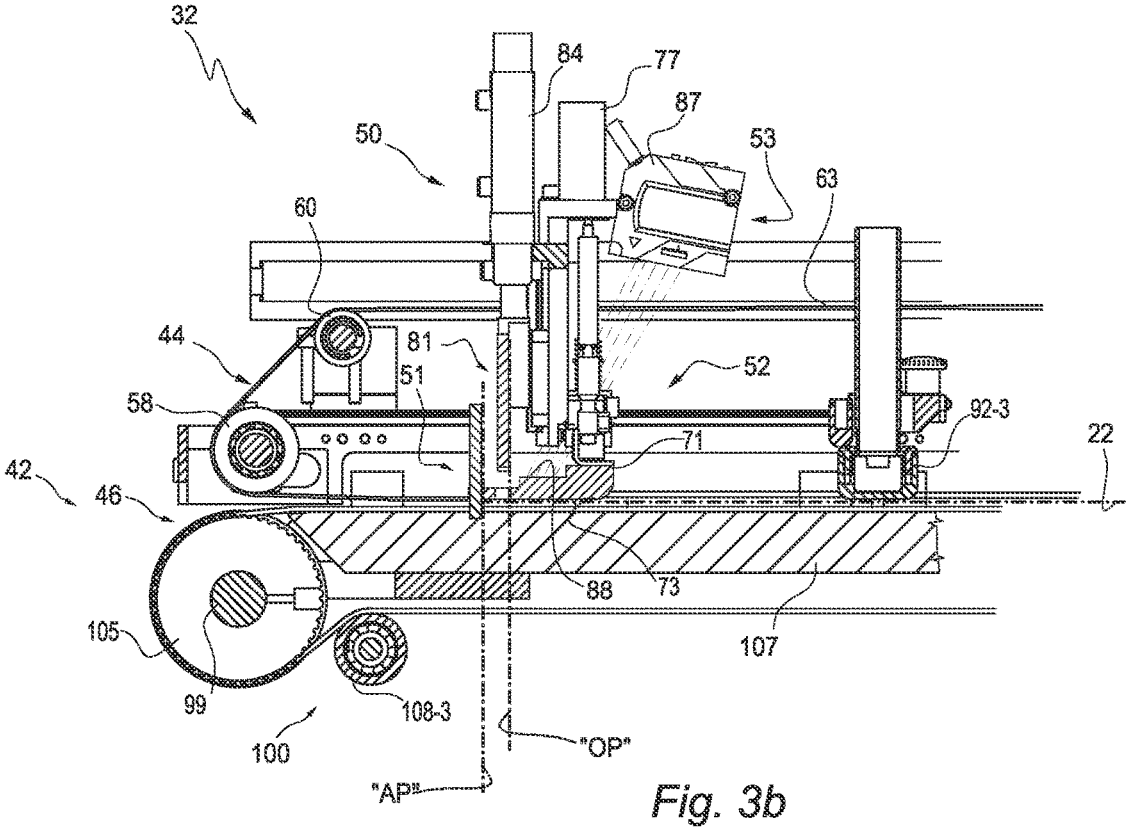

In the transport and storage group 41 (FIGS. 3, 3*a* and 3*b*), the input rollers 43 are in mutual engagement on a horizontal geometric introduction plane "IP", coplanar with the receiving surface of the alignment section 31. In particular, the input rollers 43 are driven through belts and pulleys by an introduction motor 48 controlled by the electronic unit 33 to advance in the feed direction "F" the sheets 22 emerging from the delivery rollers 40.

The transport belts 44 are of the flat type, of an extended shape and present respective lower horizontal branches 49, positioned in parallel above the stack support 46 and which define with their outer surface a transport surface "TS". The belts 44 are motorized for dragging the entering sheets with the lower branches 49 and depositing the sheets on the stack support 46 or on a last sheet of the stack 29 being formed, as will be described below.

According to the invention, the sheet stacking equipment 21 comprises in the transport and storage group 41 a functional block 50 which includes an arrest member 51 for the entering sheets 22, a pressing member 52 for the stack 29 being formed, arranged upstream of the arrest member, and a sensing device 53 for the last sheet of the stack.

Figure 5:
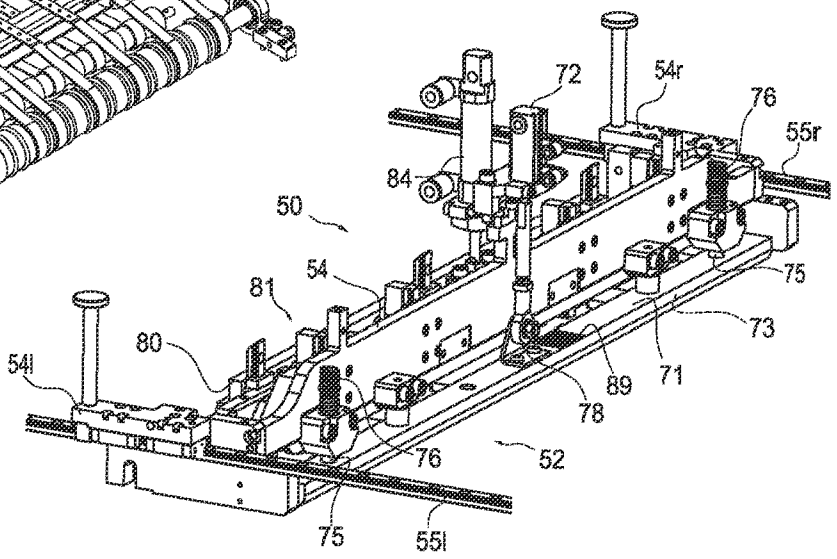
FIG. 5 represents a schematic perspective view of other components of the equipment of FIG. 1.

In particular, the functional block 50 (FIGS. 1, 3 and 5) comprises a transversal support plate 54, substantially vertical, on which the arrest member 51, the pressing member 52 and the sensing device 53 are transversally mounted. The plate 54 is provided at the sides with two slides 54*r* and 54*l* which are coupled, in a sliding manner and possibility of locking, with two lateral guides 56*r* and 56*l* fixed on the frame of the equipment 21. In this way, the arrest member 51 can be positioned according to the length of the sheets 22 to be stacked at a convenient distance from the input rollers 43, greater than the length of the sheets 22.

The arrest member 51 defines a vertical alignment plane "AP" of the stack 29 and it is designated for arresting the moving sheets 22 to be stacked. During the stacking process, the sheets 22 advance by the combined action of the input rollers 43 and the transport belts 44. The sheets 22, however, leave the rollers 43 before their leading edges come into contact with the arrest member 51, while the shifting of the sheets before the arrest is ensured only by the transport belts 44.

The pressing member 52 operates on the last sheet of the stack 29 with stabilizing function. In turn, the sensing device 53 is interlocked with the compensation mechanism 47 to ensure optimal conditions for stacking regardless of the number of stacked sheets. This, for example and in a conventional manner, by maintaining constant the height, indicated "H", between the introduction plane "IP" and the last sheet of the stack 29 or between the introduction plane "IP" and the surface of the stack support 46 in absence of sheets.

The input rollers 43 comprise in particular a driving roller 56 and a contrast roller 57, which are arranged in a tangential condition above and below the plane "IP". The transport belts 44 are stretched between the driving roller 56, a rear roller 58, upper deflection rollers 59 and 60, respectively front and rear, and a lower front deflection roller 61.

The deflection rollers 59 and 60 form the upper branches, indicated by 63, of the transport belts 44, while the deflection roller 61 and the rear roller 58 form the lower branches 49 with the transport surface "TS". The branches 63 and the branches 49 are spaced apart so as to house mechanisms of the transport and storage group 41 including the pressing member 52 and the arrest member 51. In detail, with respect to the feed direction "F", the deflection rollers 59 and 61 are arranged downstream of the driving roller 56, while the deflection roller 60 is arranged upstream of the rear roller 58 and downstream of the arrest member 51.

In operating conditions, the lower branches 49 of the transport belts 44 are arranged at a distance in height from the plane "IP" lower than the height "H", so as to leave a space "G" between the transport surface "TS" of the branches 49 and the stack support 46 or between the transport surface "TS" and the last sheet of the stack 29. The space "G" is, for example, included between 0.2 and 0.8 mm, such as to allow an easy passage of the sheets 22 to be stacked. As above reported, in the accumulation and delivery assembly 42, the compensation mechanism 47 regulates the height of the support 46 between a series of operating positions in which the height "H" is kept substantially constant. Consequently, also the space "G" between the transport surface "TS" and the last sheet of the stack 29 or the surface of the stack support, in absence of sheets is maintained constant.

Figure 4:
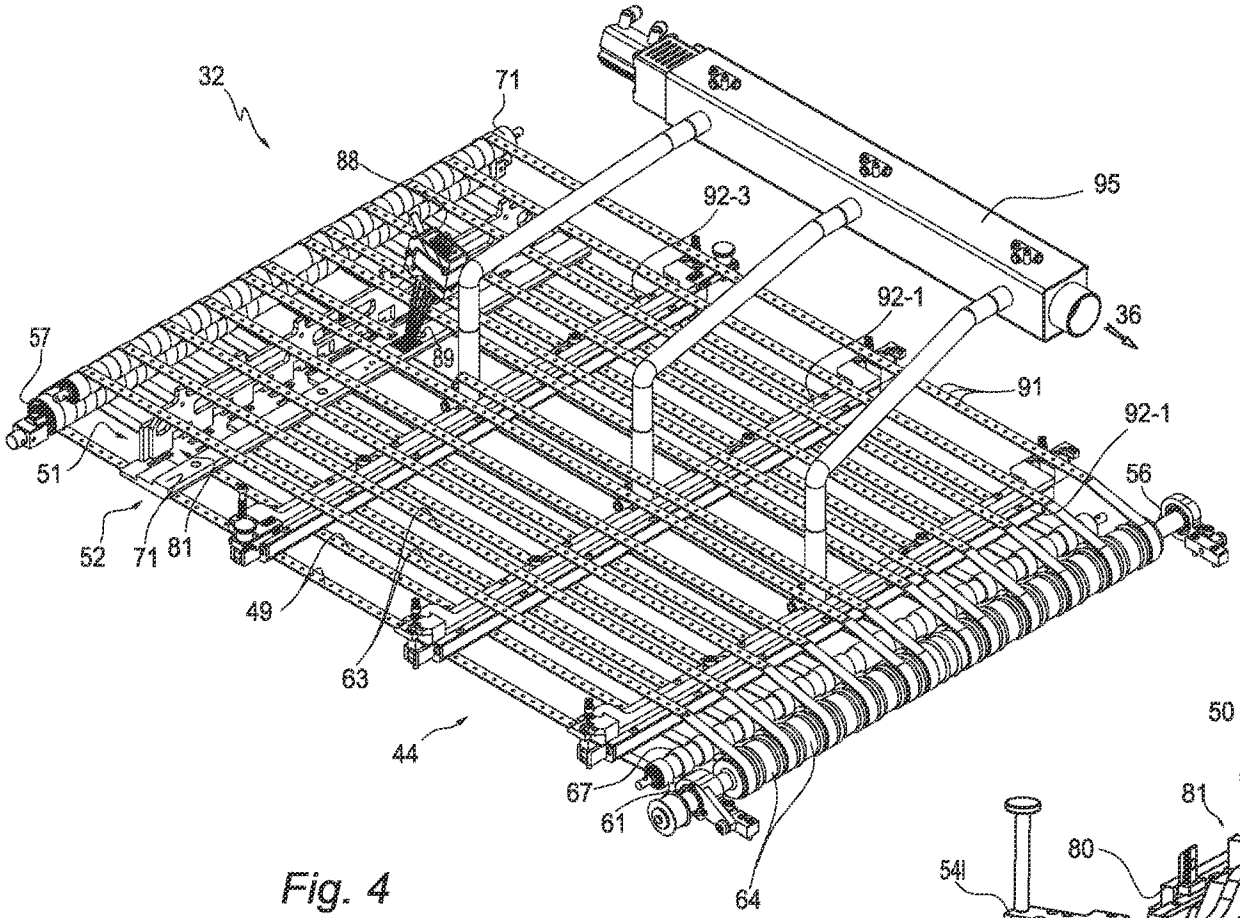
FIG. 4 represents a schematic perspective view of some components of the stacking equipment of FIG. 1.

The driving roller 56 (see FIGS. 4 and 5) defines, in a transversal direction, engagement seats for the transport belts 44, which are alternated with support seats for driving rings 64 of friction dragging for the sheets 22, and in which the engagement seats are for example made of elastomeric material. The contrast roller 57 is also made of elastomeric material.

The driving roller 56 is driven in rotation trough pulleys and belts by the introduction motor 48 for a dragging speed of the transport belts 44 slightly higher than the feeding speed of the sheets 22 emerging from the delivery rollers 40.

The lower deflection roller 61 constitutes an insertion roller for the entering sheets 22 and defines in a transversal direction guide seats for the transport belts 44 alternated with support seats for elastomeric rings 67 of friction dragging for the sheets 22. The deflection roller 61 determines belt portions 68 of the transport belts 44 included between the driving roller 56 and the roller 61 itself, inclined downwards, for guiding the leading edges of the sheets 22 emerging from the input rollers 43. Flexible detachment lugs 69 are interposed between the belt portions 68 and the end portions, in slight interference with the path of the sheets 22, for facilitating the separation of the trailing edges of the sheets 22, jointly with the leaving of the sheets from the input rollers 43.

Figure 5A:
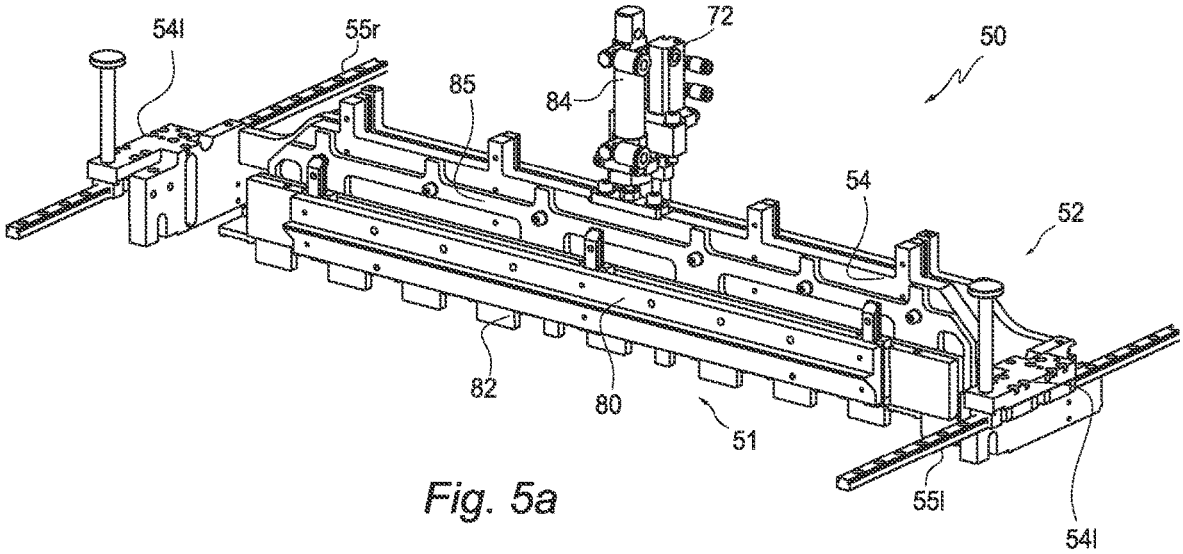
FIG. 5*a* shows another schematic perspective view of the components of FIG. 5.
Figure 5B:
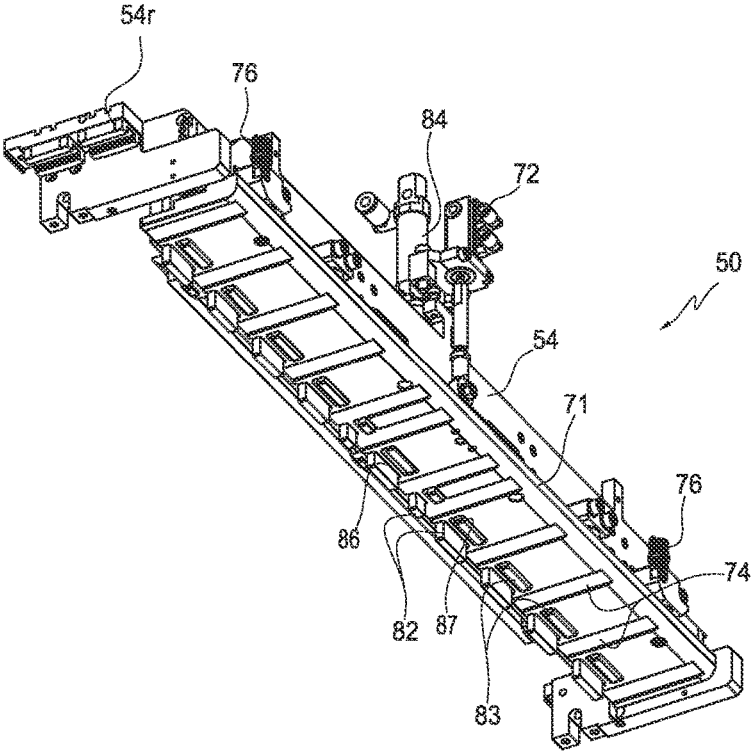
FIG. 5*b* shows a further schematic perspective view of the components of FIG. 5.
Figures 6, 6A, 6B:
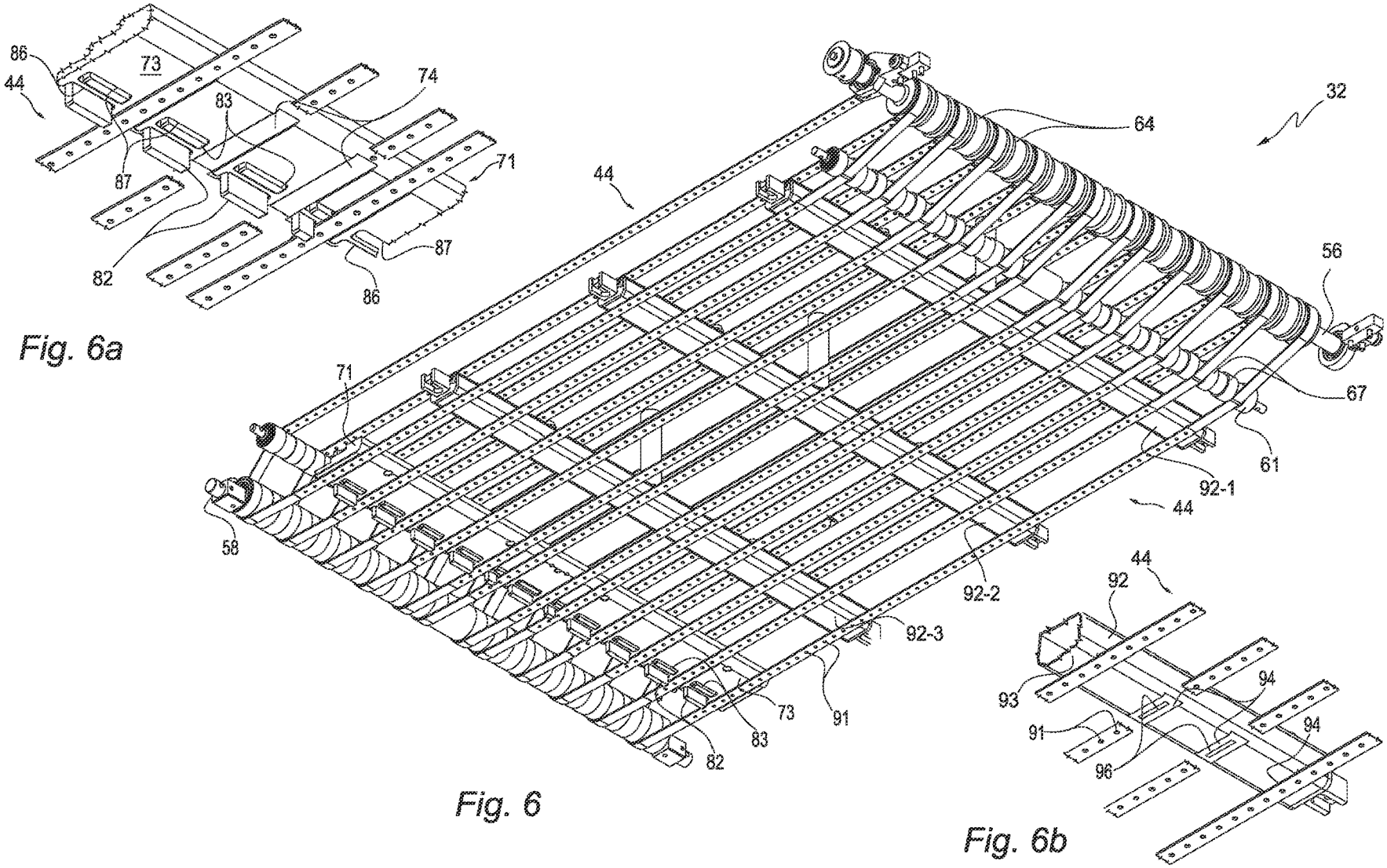
FIG. 6 represents a schematic perspective view of other components of the equipment of FIG. 1.
FIGS. 6*a* and 6*b* show some parts of FIG. 6, on an enlarged scale.

In the functional block 50, the pressing member 52 (FIGS. 3, 5 and 5*b*) comprises a pressing crossbar 71 on which a pneumatic actuator 72 operates. The crossbar 71 is contiguous to the arrest member 51 and extends in cross-section upstream of the member 51. The crossbar 71 is slidably mounted vertically on the support plate 54 and has a front slanted edge and a lower surface 73 for contrasting the stack 29 and with longitudinal notches 74 for guiding the transport belts 44. The notches 74 have a depth slightly less than the thickness of the belts 44, so as to make a section of the belts protrude from the surface 73.

The pressing crossbar 71 therefore presses on the portion of the stack 29 being formed contiguous to the plane "AP", in a pressure area adjacent to the leading edge of the sheets. This occurs through the sections of the transport belts 44 projecting from the longitudinal notches 74 and, in a direct manner, through the lower surface 73 of the crossbar 71.

In detail, the pressing crossbar 71 is connected laterally to the support plate 54 by means of compensation springs 76 and is slidably guided by vertical guides 75 coaxial with the springs 76 up to end stops. At the center, the crossbar 71 is connected to the pneumatic actuator 72 by means of a ball joint 78.

Conveniently, the action exerted by the pressing member 52 is adjustable according to the operating conditions of the equipment 21, while the springs 76 are adjusted so as to compensate for the weight of the movable parts. Specifically, the actuator 72 is connected to the compressed air generator 37 by means of a pressure regulator, not shown, which can be set on the basis of one or more of the parameters relating to: the dragging speed of the sheets, the thickness, the weight and the finishing of the sheets used, and the current height of the stack being formed. This in response of an algorithm performed by the electronic control unit 33, on the basis on experimental data under various conditions of use.

As an alternative, the actuator for the pressing crossbar 71 may be of an electromechanical type with the possibility of varying the operating pressure and manually setting said operating pressure on the basis of other considerations.

The sheet stacking equipment 21 may optionally be configured to form the stack 29 with overlapping sheets of regular blocks 79*r* and staggered blocks 79*o*. The regular blocks 79*r* are aligned according to the alignment plane "AP", while the staggered blocks 79*o* are aligned on a plane "OP" which is offset at the front with respect to the plane "AP". To this end, the transport and storage group 41 comprises an offset arrest member 81, which is also mounted on the functional block 50, upstream of the arrest member 51, and which can be actuated as an alternative to the actuation of the member 51.

The arrest member 51 is formed by a cross bar 80 with a plurality of arrest lugs 82 (see FIG. 5*a*) in a lower part, fixed behind the support plate 54. The arrest lugs 82 are aligned transversally and project from the lower branches 49 of the transport belts 44 to define the alignment plane "AP" of the stack 29.

The offset arrest member 81 comprises a vertical plate 85 with a plurality of offset lugs 83 projecting downwardly and also aligned transversally. The plate 85 is slidably mounted behind the plate 54 between the bar 80 and the plate 54 and is vertically shiftable by means of a pneumatic actuator 84 from a high, inactive position to a lowered, operative position. In the lowered position, the offset lugs 83 project from the lower branches 49 and define the offset alignment plane "OP" for the blocks 79*o* of the stack 29.

Conveniently, the crossbar 71 of the pressing member 52 defines a row of transversal notches 86 and a row of transversal windows 87. The arrest lugs 82 are freely housed in the transversal notches 86, while the offset lugs 83 are slidably guided by the transversal windows 87.

The sensing device 53 can be of any type and detects the height of the stack 29 by sensing the position of the pressing member 52 so as to minimize possible errors due to wrinkles and deformations of the last sheet of the stack. In a preferred embodiment, the device 53 comprises a laser illuminator/detector 88 mounted through a bracket (not shown) on the support plate 54 and a target area 89 formed on an upper surface of the pressing crossbar 71.

The transport belts 44 have holes 91 distributed regularly along a longitudinal axis, while the transport and storage group 41 comprises one or more ducts 92 arranged transversally above the lower branches 49 of the belts 44. The ducts 92 each define, in a lower surface 93, longitudinal notches 94 (see FIG. FIG. 5*b*) for guiding the belts 44.

The duct or ducts 92 are connected, via flexible hoses and a manifold 95, to the vacuum pump 36 and have suction openings 96 at the guide notches 94. This is to cause a suction action on the sheets 22 through the holes 91 of the transport belts 44 with dragging by adherence of the entering sheets 22 by the belts 44 up to their arrest against the lugs 82 or 83 and following sliding of the belts after the arrest of the sheets.

In the herein represented embodiment, the equipment 21 is designated for stacking sheets of considerable longitudinal extension and includes three ducts 92-1, 92-2 and 92-3: the duct 92-1 is arranged downstream of the deflection roller 61, the duct 92-3 is arranged upstream and at short distance from the pressing member 52, while the duct 92-2 is in an intermediate position between the ducts 92-1 and 92-3. It is also clear that the equipment 21 can provide a greater or lesser number of ducts 92 or a single duct depending on the lengths of the sheets to be stacked.

Conveniently, the duct or ducts 92 are mounted on slides which can slide along the lateral guides 56*r* and 56*i* and can also be positioned at different distances from the input rollers 43 depending on the length of the sheets 22.

For effective jamming-free shifting, the sheets 22 must adhere to the transport belts 44 sufficiently for dragging, but must be able to be easily detached at the time of stacking. Moreover, before the detachment and when the sheets have been arrested by the lugs 82 or 83, the sliding of the belts must not cause ripples or jams. The friction coefficient of the belts 44 is therefore an important parameter for a reliable stacking of the sheets 22.

The problems of wrinkles or other deformations of the sheets and jamming are serious if the equipment 21 should handle sheets of very different characteristics as for weight, rigidity and smoothness, variable for example from a tissue paper to a coated paper. The use of transport belts with a friction coefficient selected for reference papers of a given type may cause drawbacks when the equipment 21 handles sheets of types very different from those of the reference papers.

Advantageously, it has been found that the above problems are solved by using together transport belts for the sheet having different friction coefficients.

According to a feature of the invention, the stacking equipment 21, in the transport and storage group 41, employs 12 transport belts 44, of which eight belts with a low friction coefficient (grip 0.2 on steel) are alternated with four belts with a medium friction coefficient (grip 0.4 on steel). By virtue of this solution, the equipment 21 can reliably and at high speed (250 m/mn) stacking sheets of paper with a weight of 40 to 300 g/m2 and finishes including coating.

Figure 7:
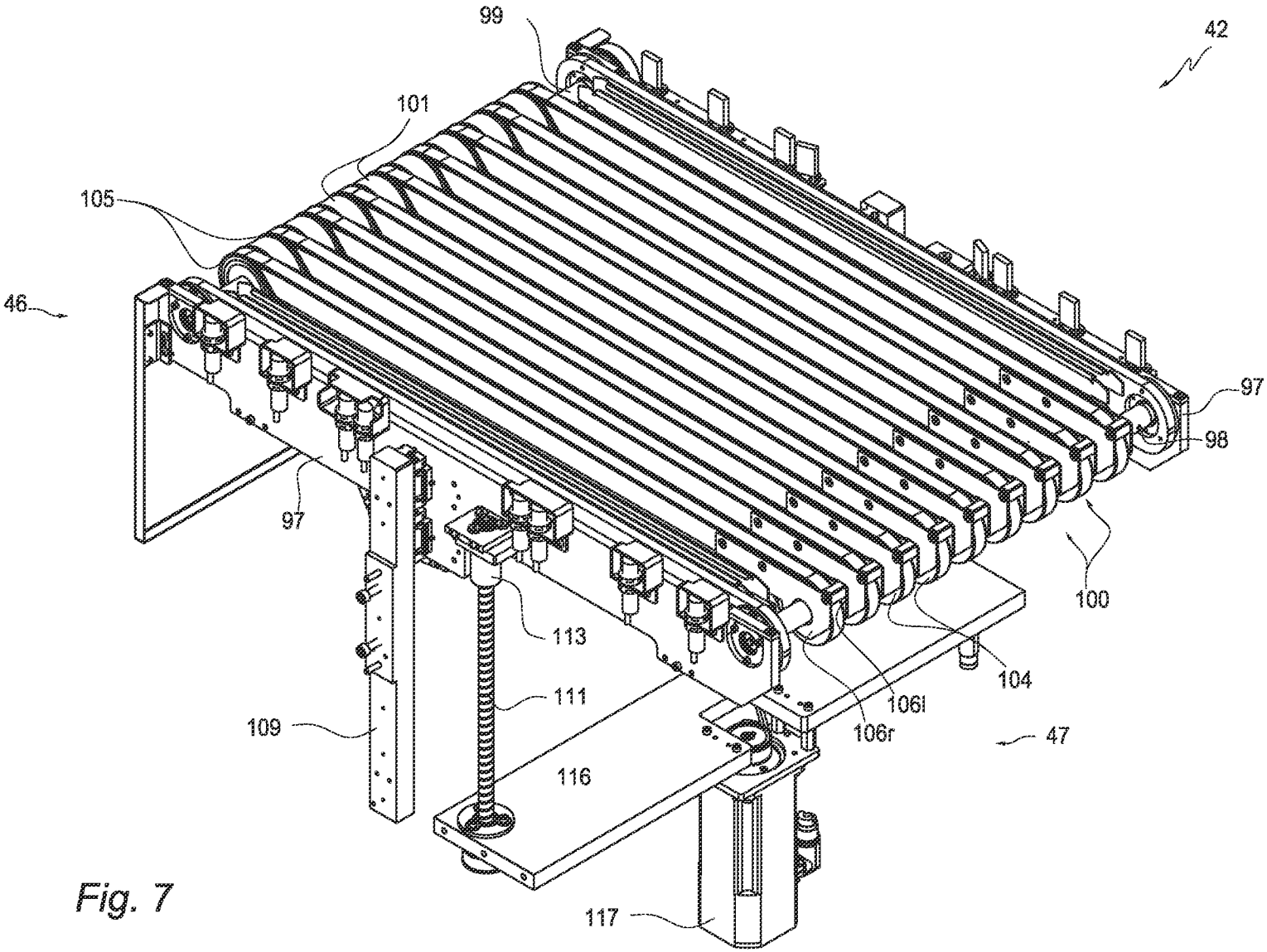
FIG. 7 shows a schematic perspective view of parts of the equipment of FIG. 1.

In the accumulation and delivery group 42, the stack support 46 (FIGS. 3, 3*b* and 7) comprises a frame 97 of rectangular outline, a pair of transversal shafts 98 and 99, a plurality of support and delivery blocks 100, driving rings 101 of the shaft 99 and a delivery motor 102.

The frame 97 extends below the transport and storage group 41 and rotatably supports the shafts 98 and 99 in respective front and rear sections.

The support and delivery blocks 100 have a longitudinally extended parallelepiped shape, and are carried side by side by the frame 97 transversally spaced from one another by the driving rings 101. The delivery motor 102 is mounted on a lower part of the frame 97 and drives the transversal shaft 99 through respective pulleys and belts.

The support and delivery blocks 100 each comprise a spar 103, a pair of pulleys 104 and 105 keyed on the shafts 98 and 99, sides 106*r* and 106*l* for the spar 103 and the pulleys 104, an extended delivery belt 107 with upper and lower branches stretched between the pulleys 104 and 105 and rollers 108-1, 108-2 and 108-3 of guide for the belt 107.

The pulleys 104 and 105 of each block 100 and the driving rings 101 present upper sectors in a condition of tangency with an upper surface of the longitudinal members 103. The pulleys 104 and the delivery belts 107 are toothed for a positive driving by the motor 102. The upper branches of the belts 107 rest with internal teeth on a upper surface of the spar 103, while the lower branches are deflected upwards by the rollers 108-1, 108-2 and 108-3.

The set of the upper branches of the delivery belts 107 defines a bearing surface "BS" for the stack 29 being formed, with contrast on the part of the spars 103. The delivery belts 107 are driven by the motor 102 in the direction "F", with sliding of the internal teeth on the upper surfaces of the spars in some operating conditions of the equipment 21.

Figure 9:
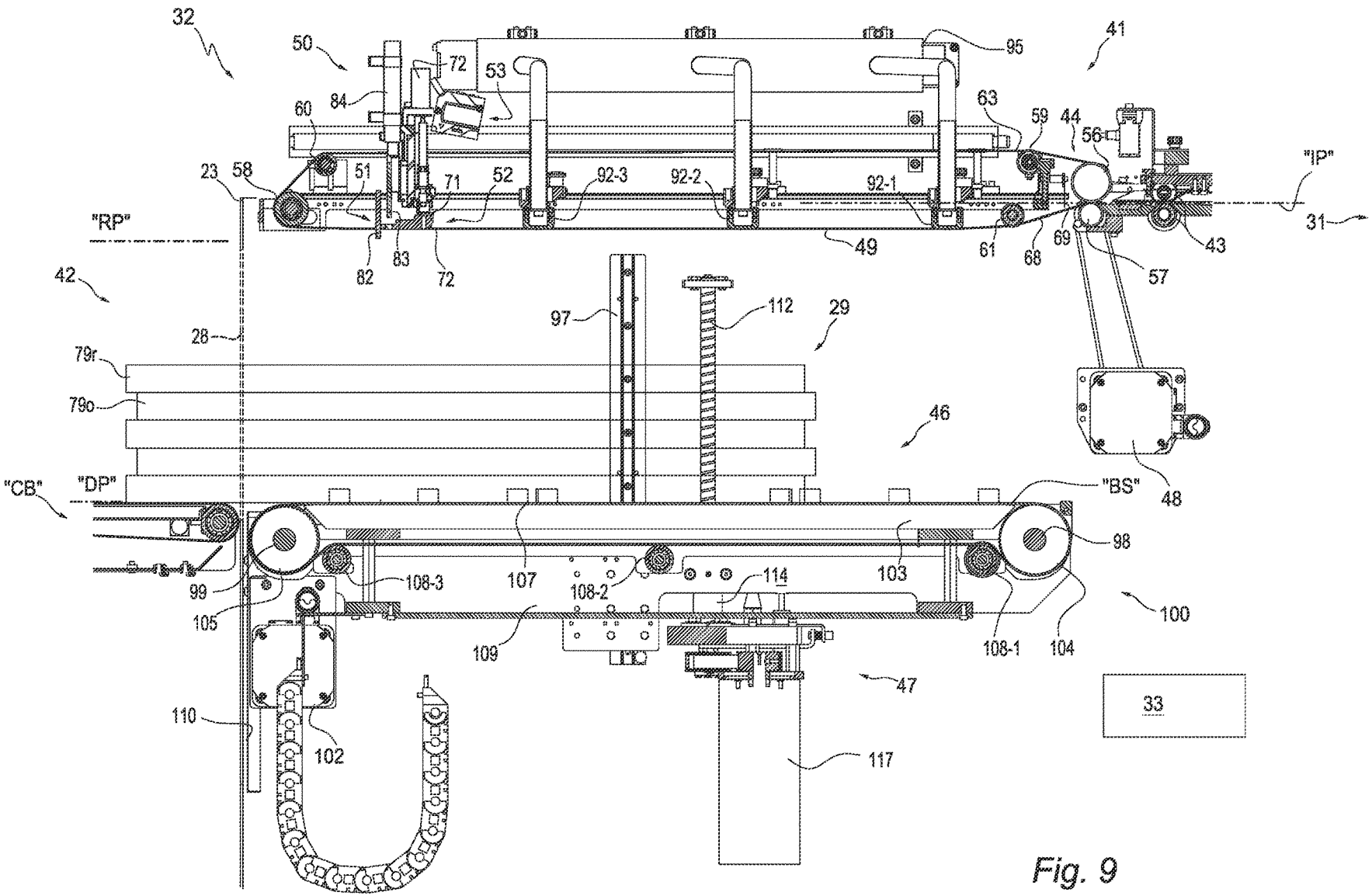
FIG. 9 shows the parts of FIG. 3 in a further operating condition.

The stack support 46 has the possibility of vertical displacement by means of vertical guides 109 between a reference position "RP" (FIG. 3) and a delivery position "DP" (FIG. 9). The reference position "RP" is the highest of the stack support 46, for a sheet-free condition in which the bearing surface "BS" of the delivery belts 104 is spaced by the space "G" from the conveying surface "TS". The delivery position "DP" is the lowest of the stack support 46 and wherein the surface "BS" is substantially coplanar with a lower edge of the output gate 28 and with the conveyor belt "CB".

Conveniently, a panel 110 is mounted vertically downward on a rear portion of the frame 97. The output gate 28 is shielded by the panel 110 when the stack support 46 is in the reference position "RP" and is free for the passage of the stack when the support 46 is in the delivery position "DP".

As above reported, depending on the number of accumulated sheets, the compensation mechanism 47 lowers the stack support 46 below the reference position "RP" to keep the space "G" constant. The mechanism 47 also moves the stack support between the position reached upon completion of the stack 29 and the delivery position "DP". In this "DP" position, the belts 107 are moved by the delivery motor 102 to forward the stack 29, through the output gate 28 toward the conveyor belt "CB" for the subsequent treatments.

The compensation mechanism 47 comprises a pair of ball screws with grooved shafts 111 and 112 and respective nut screws 113 and 114. The nut screws 113 and 114 are fixed to the sides of the frame 97, while the grooved shafts 111 and 112 are rotatably supported, with a lower end, on a transversal plate 116 and are driven in rotation, through belts and pulleys by a compensation motor 117 also controlled by the electronic unit 33.

The operation of the sheet stacking equipment 21 is as follows:

Depending on the longitudinal dimensions of the sheets 22 to be stacked, the operator positions the functional block 50 and the duct or ducts 92 at programmed distances from the input rollers 43. By means of the touch screen "CD" (FIG. 1), data are also set on the number of sheets 22 to be stacked, the number of sheets of blocks to be staggered in the case of offset stacking, and on the characteristics of the sheet. With these settings, the electronic unit 33 also regulates the pressure in the actuator 72 to optimize the operating parameters.

In an initial stage of stacking, the stack support 46 (FIG. 3) is empty and in the reference position "RP", height "H" from the plane "IP" and distance "G" between the bearing surface "BS" and the conveying surface "TS" of the branches 49 of the transport belts 44. The arrest lugs 82 are interposed in the spaces between the support and delivery blocks 100 and the crossbar 71 of the pressing member 52 presses on the delivery belts 107 at the pressure determined by the electronic unit 33. The output gate 28 is shielded by the panel 110.

Upon receipt of the first sheet 22 from the delivery rollers 40, the electronic unit 33 activates the introduction motor 48, rotating the input rollers 43 with movement of the transport belts 44 at a driving speed slightly higher than the feeding speed of the sheets 22. Moreover, limited to this first sheet, the unit 33 also activates the delivery motor 105, moving the upper branches of the delivery belts 107 in the feed direction "F" with a speed slightly higher than the speed of the sheets 22 emerging from the input rollers 43.

At the exit from the alignment section 31, the input rollers 43 advance the sheet on the introduction plane "IP" in the direction "F" and along the inclined belt portions 68. The sheet is flexed and accompanied downwards until its leading edge meets the delivery belts 107 which are in movement. This due to the positive thrust action by the rollers 43, also facilitated by the driving rings 64, the inclined portions 68 and the deflection roller 61 with the driving rings 67.

After the contact with the delivery belts 107, the sheet is flexed and accompanied horizontally again by the action of the input rollers 43 and with the contribution of the deflection roller 61, the branches 49 of the transport belts 44 and now also by the upper branches of the belts 107.

The first sheet 22 continues its travel by resting on the delivery belts 107, until its leading edge surpasses the position of the duct 92-1. Here, the sheet is lifted against the lower branches 49 of the transport belts 44. This owing to the suction action of the conduit 92-1 through the openings 96 of the guide notches 94 and through the holes 91 of the belts 44. The sheet 22 continues to advance with passage and suction of successive parts of the sheet at the openings 96, through following holes 91 of the belts 44, by the combined positive driving action of the input rollers 43 and owing to the friction dragging of the upper branches, in motion, of the delivery belts 107.

In the case where the equipment 21 also includes the ducts 92-2 and 92-3, after the lifting of the sheet 22 by the duct 92-1, the adhesion to the transport belts 44 is improved by the suction of the ducts 92-2 and 92-3, when the sheet passes in front of these ducts 92-2 and 92-3.

After leaving the trailing edge of the sheet from the input rollers 43, the sheet 22 continues to be dragged by friction by the sole transport belts 44 ensured by the suction action of the duct or ducts 92 and causing the sheet to enter completely into the transport and storage group 41. The sheet now tends to resume a flat configuration and to rest with the trailing edge on the delivery belts 107, facilitated by the detachment lugs 69.

Continuing its friction movement by the transport belts 44, the first sheet 22 meets with its leading edge the pressing member 52, with downward deviation caused by the slanted edge of the pressing crossbar 71. Through the belts 44 and the surface 73 of the crossbar 71, the actuator 72 further pushes the sheet 22 against the delivery belts 107 with the set pressure. The sheet is finally arrested when it meets the lugs 82 of the arrest member 51, with the belts 44 sliding in motion with respect to the sheet. The electronic unit 33 arrests the delivery motor 102 and consequently the belts 107 but keeps the introduction motor 48 activated and therefore the input rollers 43, the driving roller 56 and the belts 44 in motion, waiting for a following sheet 22 for stacking.

The complete introduction of the first sheet 22 into the transport and storage group 41, on command of the electronic unit 33, causes the compensation motor 117 to be actuated, rotating the grooved shafts 111 and 112 so as to lower the stack support 46 by an amount corresponding to the thickness of the sheet. This in response to feedback information from the laser illuminator/detector 88 on the position of the pressing crossbar 71 as detected in the target area 89. In this way, the space "G" intended for the passage of a new sheet to be stacked is kept constant at its optimum value.

A new sheet 22 entering the input rollers 43 is also flexed and accompanied downwards by the driving roller 56 and the inclined belt portions 68, but its leading edge now meets the preceding sheet. Due to the thrust action of the input rollers 43 and the facilitation of the roller 56 with the rings 64, the inclined portions 68 and the insertion roller 61 with the rings 67, the new sheet is flexed and accompanied horizontally and inserting itself between the lower branches 49 of the transport belts 44 and the parts of a preceding sheet still adhering to the branches 49.

The new sheet 22 continues its travel above the preceding sheet, until its leading edge reaches the duct 92-1, putting itself in contact with the lower surface 93. The part of the preceding sheet, no longer retained by the suction of the duct 92-1 falls on the surface "B S" of the support 46, while the new sheet adheres to the lower branches 49 of the transport belts 44 and is dragged by it. The new sheet then continues to advance for the passage and suction of successive parts in front of the duct 92-1 and the ducts 92-2 and 92-3, while the preceding sheet progressively rests on the upper branches of the delivery belts 107, as the first sheet of the stack 29.

The new sheet 22 also continues its movement by the transport belts 44 alone for the adhesion ensured by the duct or ducts 92 after the leaving of its trailing edge from the input rollers 43. The new sheet tends to resume a flat configuration and to rest with the trailing edge on the preceding sheet, facilitated by the detachment lugs 69. In sequence, the new sheet 22 is deflected downwards by the pressing crossbar 71 of the pressing member 52 and pressed against the underlying sheet by the actuator 72. The sheet is finally stopped when its leading edge contacts the arrest lugs 82, with sliding of the sheet with the transport belts 44 in motion.

Full introduction of the new sheet 22 into the transport and storage group 41 causes the compensation motor 117 to start again upon control of the electronic unit 33 and feedback by the sensing device 53 and further lowering of the stack support 46 by the amount corresponding to the thickness of the sheet so as to keep the space "G" constant.

The following sheets are stacked sequentially as described above for the second sheet, with progressive formation of the stack 29.

If the offset option is provided, after the setting of the number of sheets constituting each regular block **79*r* has been stacked, the electronic unit 33 activates the offset actuator 84. The offset lugs 83 are lowered through the windows 87 of the pressing crossbar 71 placing the ends below the lower branches 49, whereby determining the offset alignment plane "OP" for the staggered blocks 79*o***.

During stacking, the pressing member 52 exerts its action on a pressure area of the sheets adjacent to the pressing member. This prevents the impact of an entering sheet against the arrest lugs 82 or against the offset lugs 83 and the thrust of the transport belts 44 from causing the leading edge to be lifted and the sheet to curl, resulting in overlapping and jamming upon arrival of the subsequent sheets. In turn, the detection of the position of the sheet previously stacked by means of the target area 89 of the pressing crossbar 71, as information for maintaining the best height "H", prevents wrinkles or deformations on the stacked sheet from giving rise to errors in the position of the support 46 and space values "G" different from the optimal one, with other risks of jams for the new sheet to be stacked.

Figure 8:
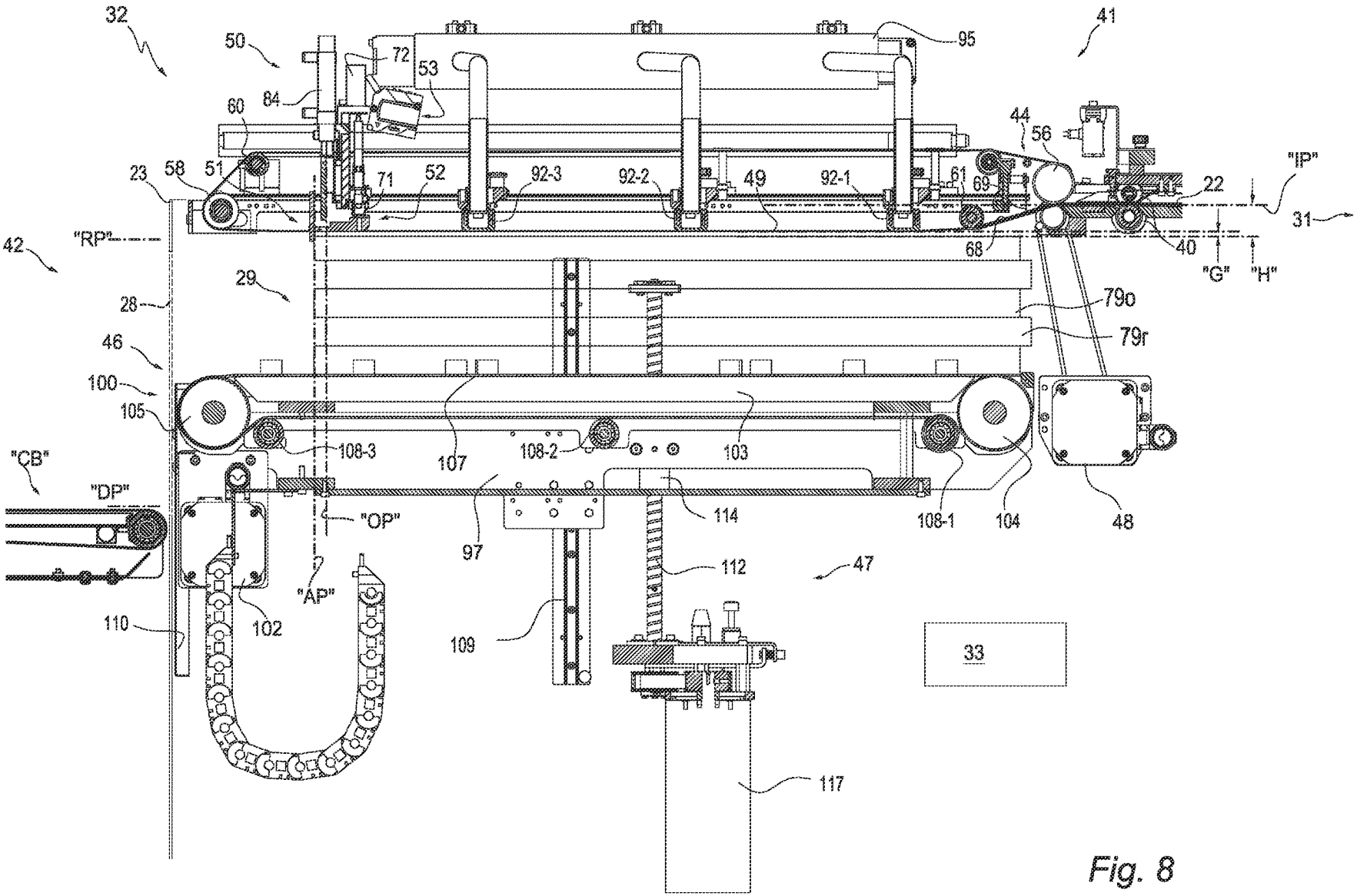
FIG. 8 shows the parts of FIG. 3 in another operating condition.

Upon reaching the number of sheets 22 or the number of blocks **79*r* and 79*o* to be stacked, the electronic unit 33 again activates the compensation motor 117, moving the stack support 46 from the last stacking position to the delivery position "DP", without any servo to the sensing device 53. The bearing surface "BS" of the delivery belts 107 (FIG. 8) is now coplanar with the conveyor belt "CB" and the panel 110 is below the output gate 28**, completely discovering it.

The electronic unit 33 now activates the delivery motor 102, moving the upper branches of the delivery belts 107 in the "F" direction, and consequently dragging the stack 29 with the sheets stacked on the conveyor belt "CB" for delivery to the user equipment.

Upon completion of the delivery of the stack 29, the electronic unit 33 arrests the motor 102 and activates the compensation motor 117, with rotation of the splined shafts 111 and 112 in the opposite direction to the lowering direction, lifting the stack support 46 up to the reference position "RP" of FIG. 3 for the start of a new stacking.

It is expressly contemplated that the principle of the invention remaining the same, the embodiments and details of construction of the equipment for stacking sheets may be widely varied with respect to what has been described and illustrated by way of non-limiting example, without by this departing from the ambit of the present invention.

What is claimed is:

1. An equipment for stacking sheets comprising a stack support for sheets in vertical stacking, input rollers for introducing and feeding sheets along a given direction, a plurality of elongated transport belts with lower branches arranged above the stack support and a compensation mechanism for modifying a height of the stack support with respect to a reference surface and wherein the transport belts are motorized for shifting entering sheets with the lower branches and depositing the sheets on the stack support or on stacked sheets, wherein said equipment further comprises an arrest member for the entering sheets, a pressing member for a forming stack, a sensor device for the height of a last sheet of the stack and an electronic control unit, wherein the arrest member is designated for arresting and aligning sheets in stacking against a stack alignment surface;

the pressing member being contiguous to the arrest member and operates on a last sheet of the stack on a pressing area adjacent to a leading edge of the last sheet of the stack with a stabilization function; and the pressing member comprising a pressing cross member having a lower surface of contrast for the stack, the cross member operates on the pressing area of the last sheet of the stack with its lower surface, and wherein the compensation mechanism is servoized to the sensor device, on control by the electronic control unit, for maintaining constant the height of the last sheet of the stack from the reference surface, wherein the input rollers comprise a driving roller, while the transport belts are extended between the driving roller, a rear roller and deflection rollers, and in which the deflection rollers include an insertion roller for the lower branches of the belts, the entering sheets emerging from the input rollers are deviated towards the stack support by inclined sections of the belts included between the driving roller and the insertion roller and wherein flexible detachment lugs interposed between the inclined belt sections are provided for facilitating detachment of the entering sheets from the transport belts, jointly with the leaving of the sheets from the input rollers.

2. The equipment according to claim 1, further comprising a functional block which includes a support on which are mounted the arrest member, the pressing member and a sensor device for the compensation mechanism and wherein the support is longitudinally shiftable so as to position the arrest member at a distance from the input rollers depending on the length of the sheets to be stacked, greater than the length of the sheets.

3. An equipment for stacking sheets comprising a stack support for sheets in vertical stacking, input rollers for introducing and feeding sheets along a given direction, a plurality of elongated transport belts with lower branches arranged above the stack support and a compensation mechanism for modifying a height of the stack support with respect to a reference surface and wherein the transport belts are motorized for shifting entering sheets with the lower branches and depositing the sheets on the stack support or on stacked sheets, wherein said equipment further comprises an arrest member for the entering sheets, a pressing member for a forming stack, a sensor device for a height of a last sheet of the stack and an electronic control unit, wherein the arrest member is designated for arresting and aligning sheets in stacking against a stack alignment surface;

the pressing member being contiguous to the arrest member and operates on the last sheet of the stack on a pressing area adjacent to a leading edge of the last sheet of the stack with a stabilization function; and the pressing member comprising a pressing cross member having a lower surface of contrast for the stack, the cross member operates on the pressing area of the last sheet of the stack with its lower surface, and wherein the compensation mechanism is servoized to the sensor device, on control by the electronic control unit, for maintaining constant the height of the last sheet of the stack from the reference surface, wherein the lower surface of the pressing cross member defines longitudinal notches of guide for the transport belts and wherein the lower surface of the cross member further operates on the pressing area of the last sheet of the stack through sections of the belts guided by the longitudinal notches.

4. The equipment according to claim 3, wherein the sensor device is functional to a height of the pressing cross member with respect to the reference surface.

5. The equipment according to claim 4, wherein the sensor device includes an illuminator/detector laser and wherein the pressing cross member defines a target area for the illuminator/detector laser.

6. The equipment according to claim 3, further comprising one or more ducts arranged transversely above the lower branches of the transport belts and with guiding areas for the branches, the transport belts have longitudinal holes, and wherein the duct or ducts are connected to a vacuum source and have openings in correspondence with the guiding areas for a suction action, trough the holes, on the entering sheets with dragging due to adhesion of the entering sheets by the transport belts.

7. The equipment according to claim 3, wherein the transport belts comprise two groups of belts having different grips, respectively.

8. The equipment according to claim 7, wherein one of the two groups of the transport belts has a low coefficient of friction with a grip of 0.2 on steel.

9. The equipment according to claim 7, wherein one of the two groups of the transport belts has a medium coefficient of friction with a grip of 0.4 on steel.

10. The equipment according to claim 3, wherein the stack support comprises a plurality of elongated delivery belts and elongated supports for the belts, wherein the stack support is connected with the compensation mechanism, while the elongated delivery belts have respective upper branches which are guided by the elongated supports and are of support for the sheets in stacking, wherein the stack support is vertically shiftable to a delivery position and the delivery belts are longitudinally shiftable by a delivering motor, and wherein the delivering motor is actuatable for forwarding the stacked sheets to following treatments in the delivery position of the stack support.

11. An equipment for stacking sheets comprising a stack support for sheets in vertical stacking, input rollers for introducing and feeding sheets along a given direction, a plurality of elongated transport belts with lower branches arranged above the stack support and a compensation mechanism for modifying a height of the stack support with respect to a reference surface and wherein the transport belts are motorized for shifting entering sheets with the lower branches and depositing the sheets on the stack support or on stacked sheets, wherein said equipment further comprises an arrest member for the entering sheets, a pressing member for a forming stack, a sensor device for a height of a last sheet of the stack and an electronic control unit, wherein the arrest member is designated for arresting and aligning sheets in stacking against a stack alignment surface;

the pressing member being contiguous to the arrest member and operates on the last sheet of the stack on a pressing area adjacent to a leading edge of the last sheet of the stack with a stabilization function; and the pressing member comprising a pressing cross member having a lower surface of contrast for the stack, the cross member operates on the pressing area of the last sheet of the stack with its lower surface, and wherein the compensation mechanism is servoized to the sensor device, on control by the electronic control unit, for maintaining constant the height of the last sheet of the stack from the reference surface, said equipment further comprising an actuator for the operation of the pressing cross member, the cross member is slidably mounted on a support structure and is connected to the support structure by means of springs of compensation for its weight, and wherein the actuator can be adjusted for modifying its action on the pressing cross member.

12. The equipment according to claim 11, wherein the pressing member is operated by a pneumatic actuator and wherein the electronic control unit determines an operating pressure of the actuator on the basis of one or more of the following parameters: sheet shifting speed, thickness, weight and finish of used sheets, and current height of the stack in formation.

13. An equipment for stacking sheets comprising a stack support for sheets in vertical stacking, input rollers for introducing and feeding sheets along a given direction, a plurality of elongated transport belts with lower branches arranged above the stack support and a compensation mechanism for modifying a height of the stack support with respect to a reference surface and wherein the transport belts are motorized for shifting entering sheets with the lower branches and depositing the sheets on the stack support or on stacked sheets, wherein said equipment further comprises an arrest member for the entering sheets, a pressing member for a forming stack, a sensor device for a height of a last sheet of the stack and an electronic control unit, wherein the arrest member is designated for arresting and aligning sheets in stacking against a stack alignment surface;

the pressing member being contiguous to the arrest member and operates on the last sheet of the stack on a pressing area adjacent to a leading edge of the last sheet of the stack with a stabilization function; and the pressing member comprising a pressing cross member having a lower surface of contrast for the stack, the cross member operates on the pressing area of the last sheet of the stack with its lower surface, and wherein the compensation mechanism is servoized to the sensor device, on control by the electronic control unit, for maintaining constant the height of the last sheet of the stack from the reference surface, said equipment further comprising an offset arrest member as an alternative to the arrest member for arresting the entering sheets against an offset surface of the stack, which is offset with respect to the stack alignment surface, the arrest member and the offset arrest member are formed by a plurality of arrest lugs and by a plurality of transversal offset lugs and wherein the pressing member comprises a pressing crossbar with a lower surface for contrasting the stack and housing windows for the arrest lugs and the offset lugs.

14. An equipment for stacking sheets comprising a stack support for sheets in vertical stacking, input rollers for introducing and feeding sheets along a given direction, a plurality of elongated transport belts with lower branches arranged above the stack support and a compensation mechanism for modifying a height of the stack support with respect to a reference surface and wherein the transport belts are motorized for shifting entering sheets with the lower branches and depositing the sheets on the stack support or on stacked sheets, wherein said equipment further comprises an arrest member for the entering sheets, a pressing member for a forming stack, a sensor device for a height of a last sheet of the stack and an electronic control unit, wherein the arrest member is designated for arresting and aligning sheets in stacking against a stack alignment surface;

the pressing member being contiguous to the arrest member and operates on the last sheet of the stack on a pressing area adjacent to a leading edge of the last sheet of the stack with a stabilization function; and the pressing member comprising a pressing cross member having a lower surface of contrast for the stack, the cross member operates on the pressing area of the last sheet of the stack with its lower surface, and wherein the compensation mechanism is servoized to the sensor device, on control by the electronic control unit, for maintaining constant the height of the last sheet of the stack from the reference surface, said equipment further comprising a functional block which includes a mounting support for the arrest member, the pressing member and the sensor device and wherein the mounting support is longitudinally shiftable so as to position the arrest member at a distance from the input rollers depending on the length of the sheets to be stacked, greater than the length.

15. An equipment for stacking sheets comprising a stack support for sheets in vertical stacking, input rollers for introducing and feeding sheets along a given direction, a plurality of elongated transport belts with lower branches arranged above the stack support and a compensation mechanism for modifying a height of the stack support with respect to a reference surface and wherein the transport belts are motorized for shifting entering sheets with the lower branches and depositing the sheets on the stack support or on stacked sheets, wherein said equipment further comprises an arrest member for the entering sheets, a pressing member for a forming stack, a sensor device for a height of a last sheet of the stack and an electronic control unit, wherein the arrest member is designated for arresting and aligning sheets in stacking against a stack alignment surface;

the pressing member being contiguous to the arrest member and operates on the last sheet of the stack on a pressing area adjacent to a leading edge of the last sheet of the stack with a stabilization function; and the pressing member comprising a pressing cross member having a lower surface of contrast for the stack, the cross member operates on the pressing area of the last sheet of the stack with its lower surface, and wherein the compensation mechanism is servoized to the sensor device, on control by the electronic control unit, for maintaining constant the height of the last sheet of the stack from the reference surface, wherein the stack support comprises a plurality of elongated delivery belts and support members for the delivery belts, the stack support is operatively connected with the compensation mechanism, while the elongated delivery belts have respective upper branches which are guided by the stack support, wherein the stack support can be vertically moved to a delivery position, the transport belts are longitudinally driven by a delivery motor and wherein the delivery motor is operable for forwarding the stacked sheets to following treatments in the delivery position of the stack support.

* * * * *